US011491545B2

(12) United States Patent
Choi et al.

(10) Patent No.: US 11,491,545 B2
(45) Date of Patent: *Nov. 8, 2022

(54) METHOD OF PREPARING MAGNETIC POWDER, AND MAGNETIC POWDER

(71) Applicant: LG Chem, Ltd., Seoul (KR)

(72) Inventors: Ikjin Choi, Daejeon (KR); Soon Jae Kwon, Daejeon (KR); Ingyu Kim, Daejeon (KR); Hyounsoo Uh, Daejeon (KR)

(73) Assignee: LG Chem, Ltd.

( * ) Notice: Subject to any disclaimer, the term of this patent is extended or adjusted under 35 U.S.C. 154(b) by 205 days.

This patent is subject to a terminal disclaimer.

(21) Appl. No.: 16/648,495

(22) PCT Filed: Aug. 14, 2019

(86) PCT No.: PCT/KR2019/010377

§ 371 (c)(1),
(2) Date: Mar. 18, 2020

(87) PCT Pub. No.: WO2020/040480

PCT Pub. Date: Feb. 27, 2020

(65) Prior Publication Data

US 2020/0222987 A1 Jul. 16, 2020

(30) Foreign Application Priority Data

Aug. 24, 2018 (KR) ..... KR10-2018-0099499

(51) Int. Cl.
*B22F 9/20* (2006.01)
*B22F 1/02* (2006.01)
(Continued)

(52) U.S. Cl.
CPC ..... *B22F 9/20* (2013.01); *B22F 1/16* (2022.01); *B22F 9/04* (2013.01); *C22C 38/002* (2013.01);
(Continued)

(58) Field of Classification Search
None
See application file for complete search history.

(56) References Cited

U.S. PATENT DOCUMENTS 4,767,450 A 8/1988 Ishigaki et al.
5,858,124 A 1/1999 Endo et al.
(Continued)

FOREIGN PATENT DOCUMENTS

JP H0372011 A 3/1991
JP H04224608 A 8/1992
(Continued)

OTHER PUBLICATIONS

International Search Report for Application No. PCT/KR2019/010377 dated Dec. 2, 2019, 2 pages.
(Continued)

*Primary Examiner* — Xiaowei Su
(74) *Attorney, Agent, or Firm* — Lerner, David, Littenberg, Krumholz & Mentlik, LLP

(57) ABSTRACT

A method of preparing magnetic powder includes preparing iron powder by a reduction reaction of iron oxide; preparing magnetic powder by heat-treating a molded article prepared by pressure-molding a mixture containing the iron powder, neodymium oxide, boron and calcium at a pressure of 22 MPa or more; and coating an organic fluoride on a surface of the magnetic powder.

18 Claims, 9 Drawing Sheets

(51) Int. Cl.

| | |
|---|---|
| ***B22F 9/04*** | (2006.01) |
| ***H01F 1/057*** | (2006.01) |
| ***C22C 38/00*** | (2006.01) |
| ***B22F 1/16*** | (2022.01) |

(52) U.S. Cl.
CPC ..... *C22C 38/005* (2013.01); *H01F 1/0577* (2013.01)

(56) References Cited

U.S. PATENT DOCUMENTS

| | | | | |
|---|---|---|---|---|
| 6,447,621 | B1 * | 9/2002 | Tokoro | H01F 1/0577 148/302 |
| 8,940,075 | B2 * | 1/2015 | Hwang | B22F 1/065 75/356 |
| 2004/0216811 | A1 | 11/2004 | Ikegami | |
| 2007/0065677 | A1 | 3/2007 | Satsu et al. | |
| 2012/0114515 | A1 | 5/2012 | Kaneko et al. | |
| 2014/0076819 | A1 | 3/2014 | Zhang et al. | |
| 2016/0086704 | A1 | 3/2016 | Namkung et al. | |
| 2019/0292635 | A1 | 9/2019 | In et al. | |
| 2021/0047711 | A1 * | 2/2021 | Kim | B22F 1/16 |

FOREIGN PATENT DOCUMENTS

| | | | |
|---|---|---|---|
| JP | H04247813 | A | 9/1992 |
| JP | H08259976 | A | 10/1996 |
| JP | H09186010 | A | 7/1997 |
| JP | 2000034502 | A | 2/2000 |
| JP | 2005057191 | A | 3/2005 |
| JP | 2007088108 | A | 4/2007 |
| JP | 2009260290 | A | 11/2009 |
| JP | 2011082467 | A | 4/2011 |
| JP | 2015048509 | A | 3/2015 |
| KR | 20020019692 | A | 3/2002 |
| KR | 20150033423 | A | 4/2015 |
| KR | 20180051224 | A | 5/2018 |
| WO | 2001020620 | A1 | 3/2001 |

OTHER PUBLICATIONS

Extended European Search Report including Written Opinion for Application No. EP19852496.9, dated Nov. 25, 2020, pp. 1-7.

* cited by examiner

【FIG. 1】
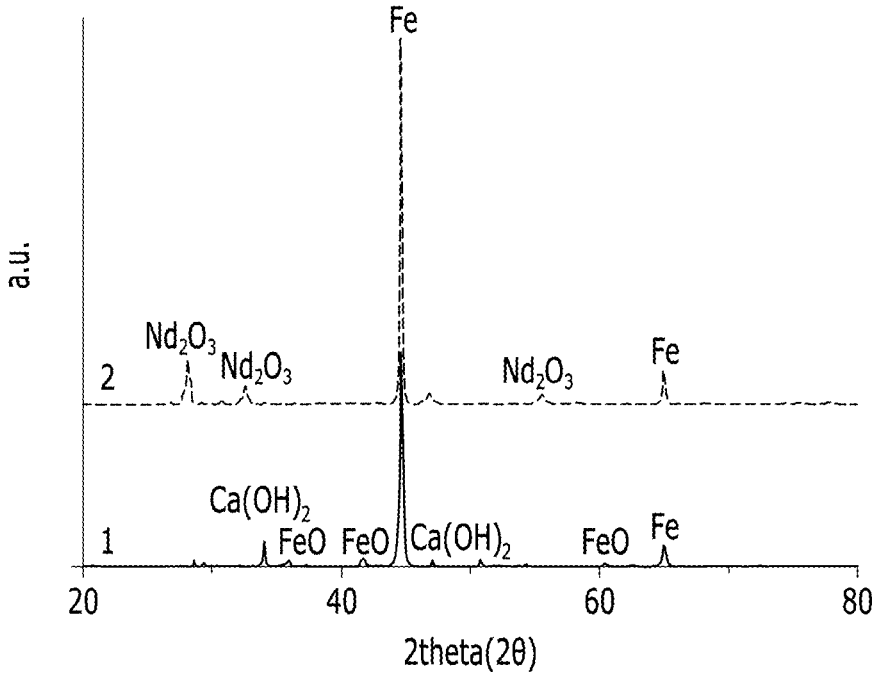

【FIG. 2】
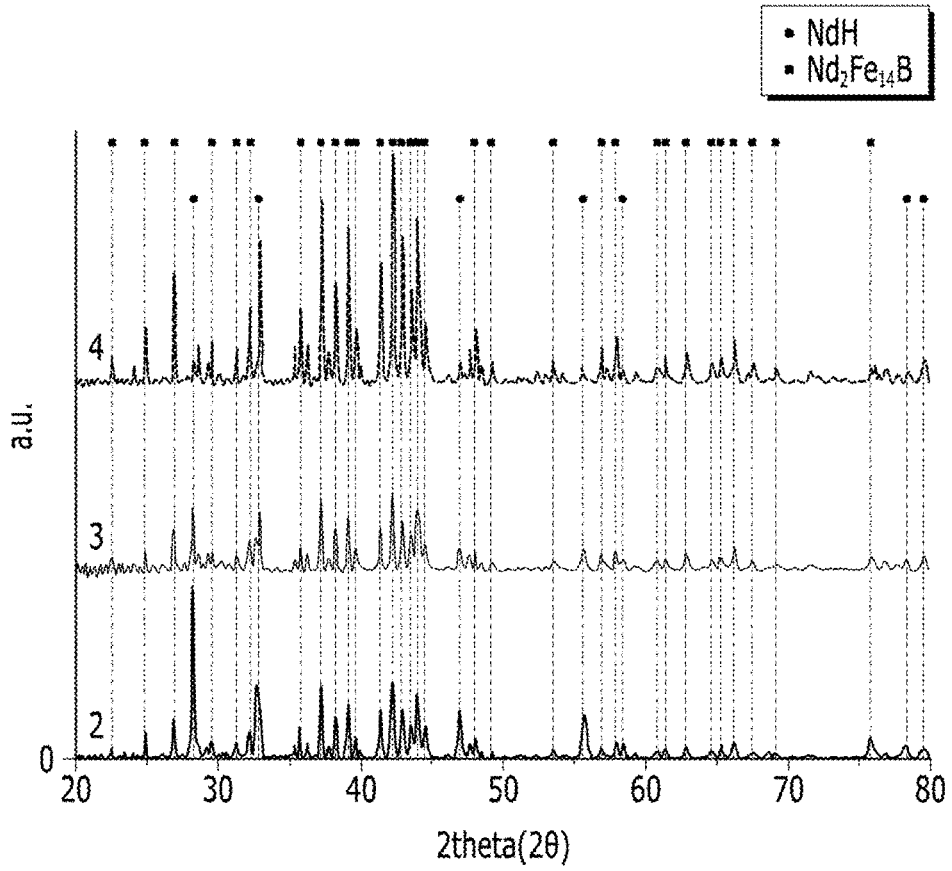

【FIG. 3】
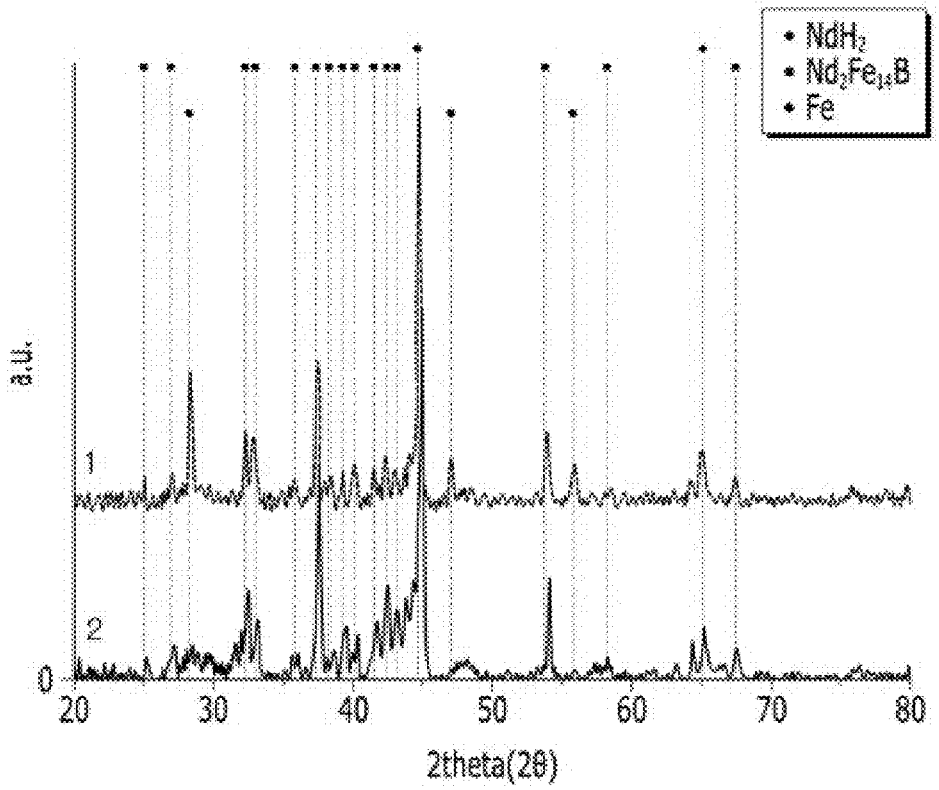

【FIG. 4a】
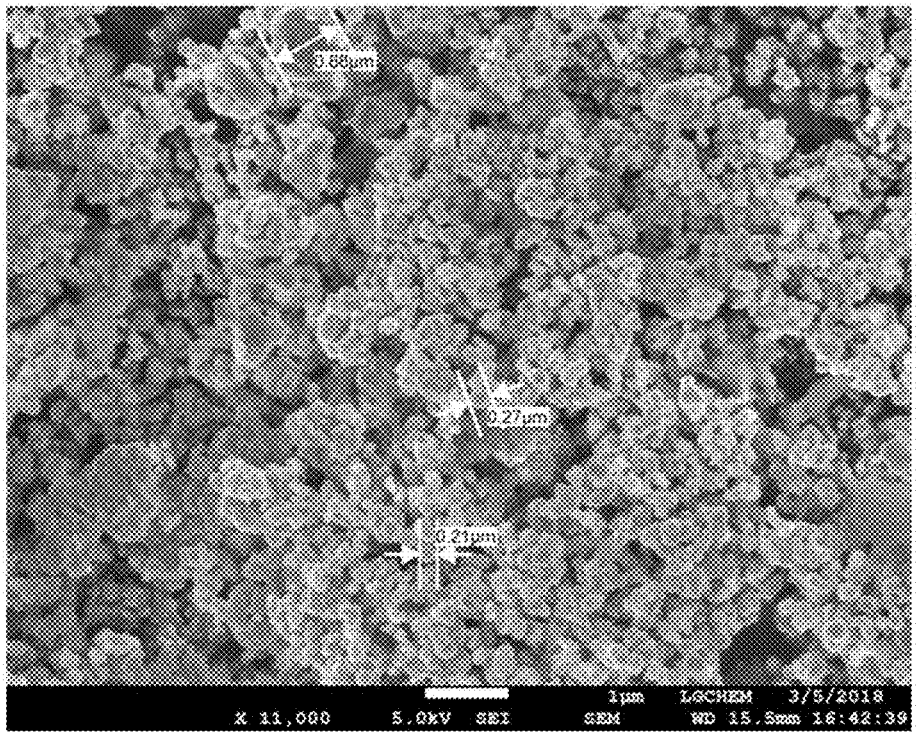
【FIG. 4b】
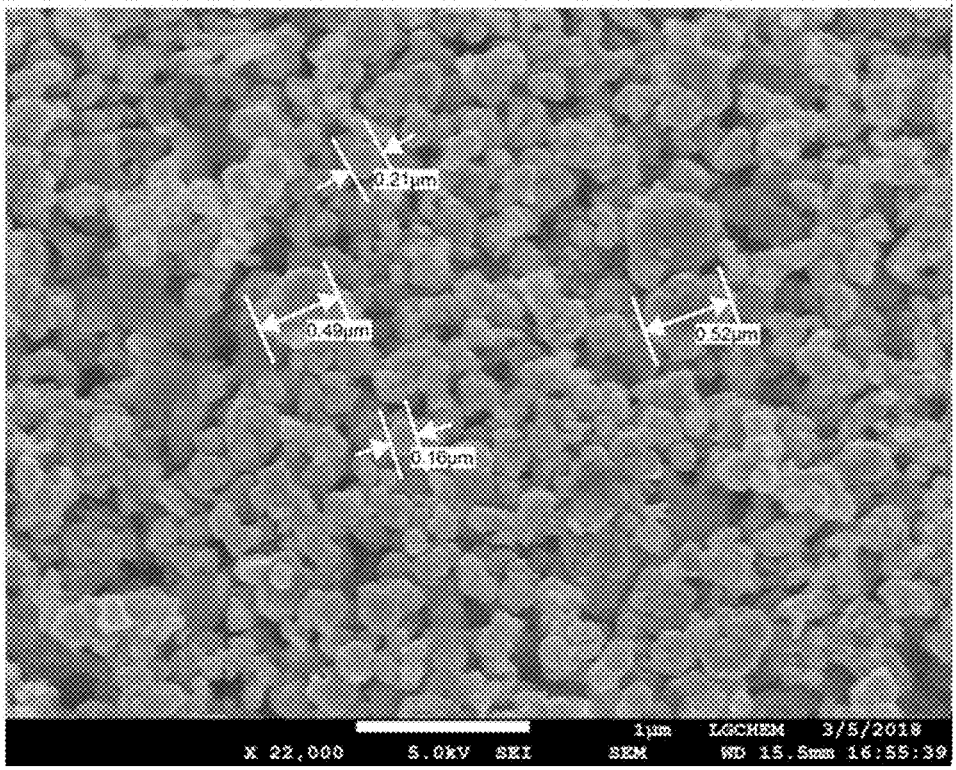

【FIG. 5a】
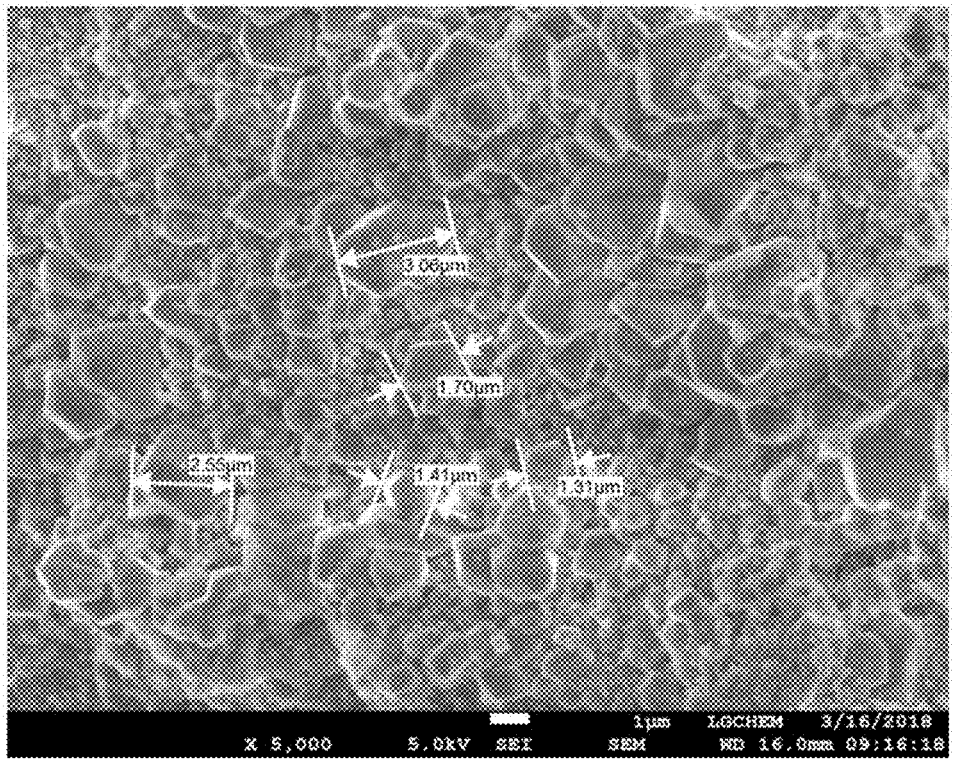
【FIG. 5b】
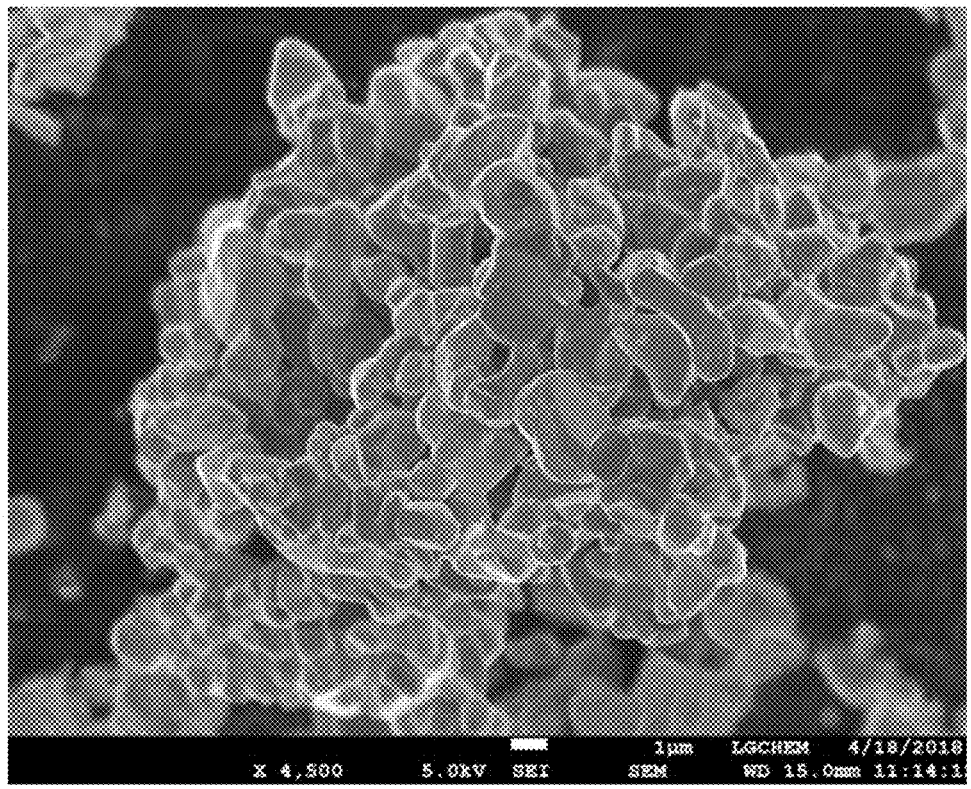

【FIG. 6】
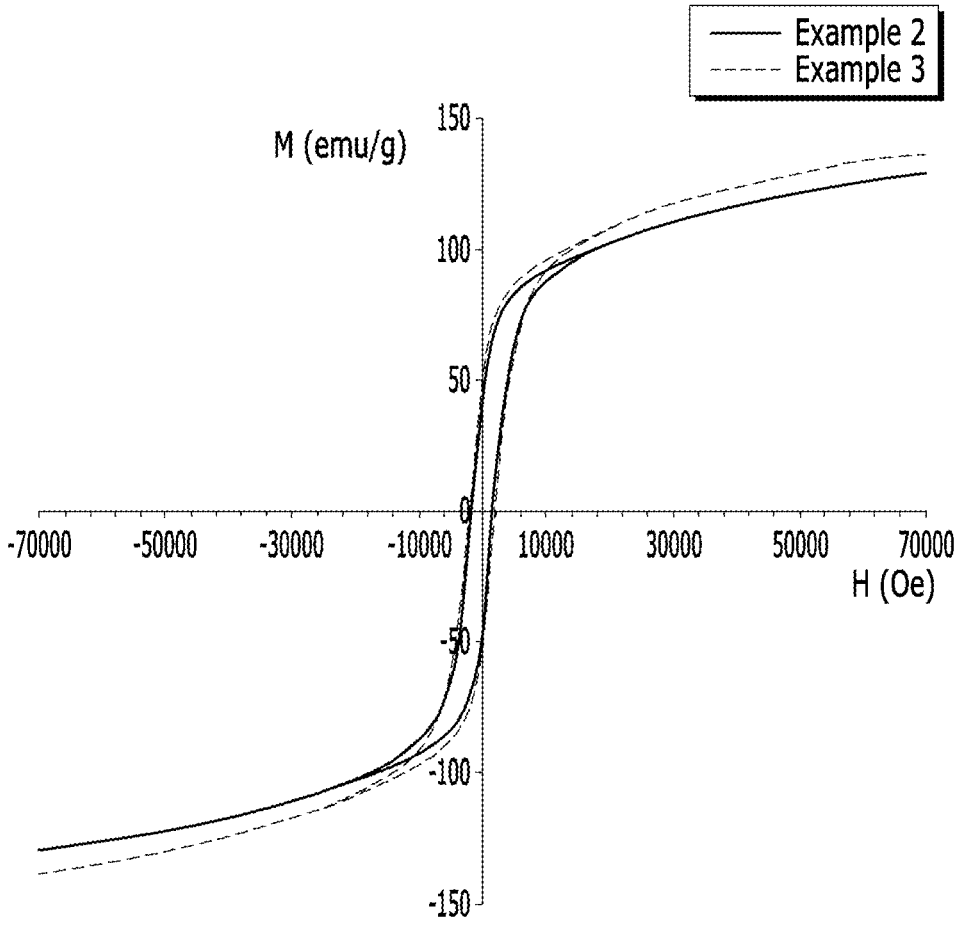

【FIG. 7】
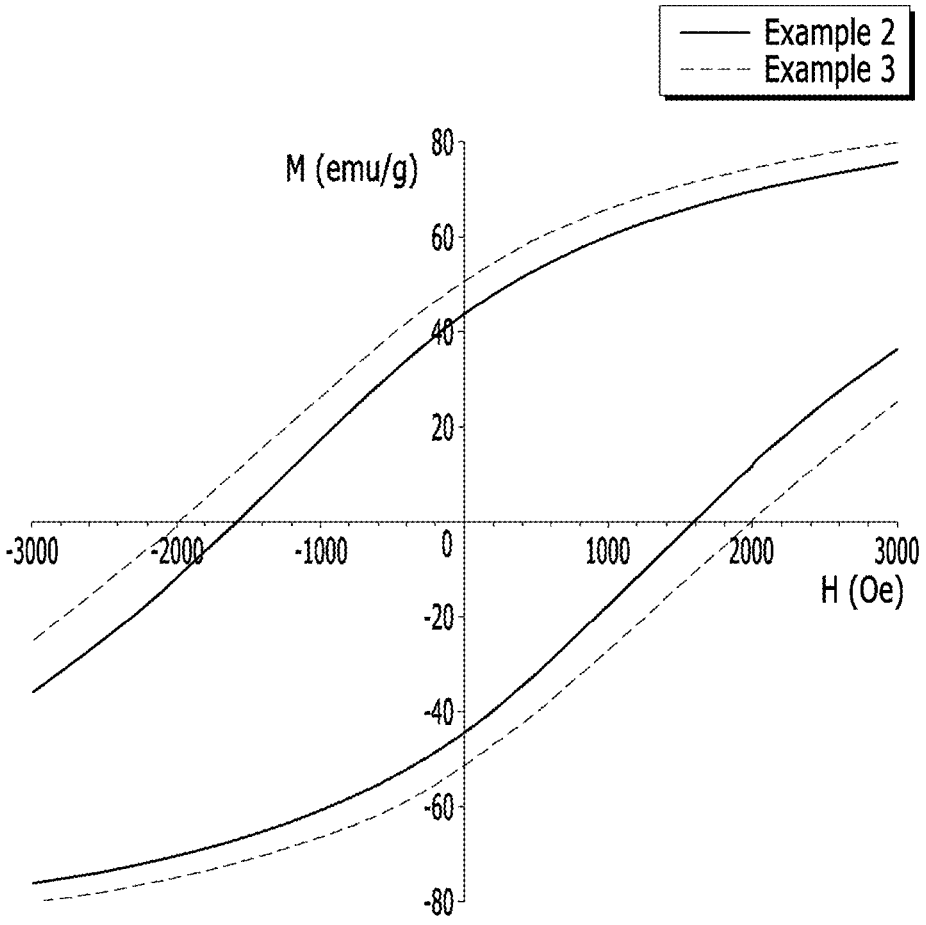

【FIG. 8】
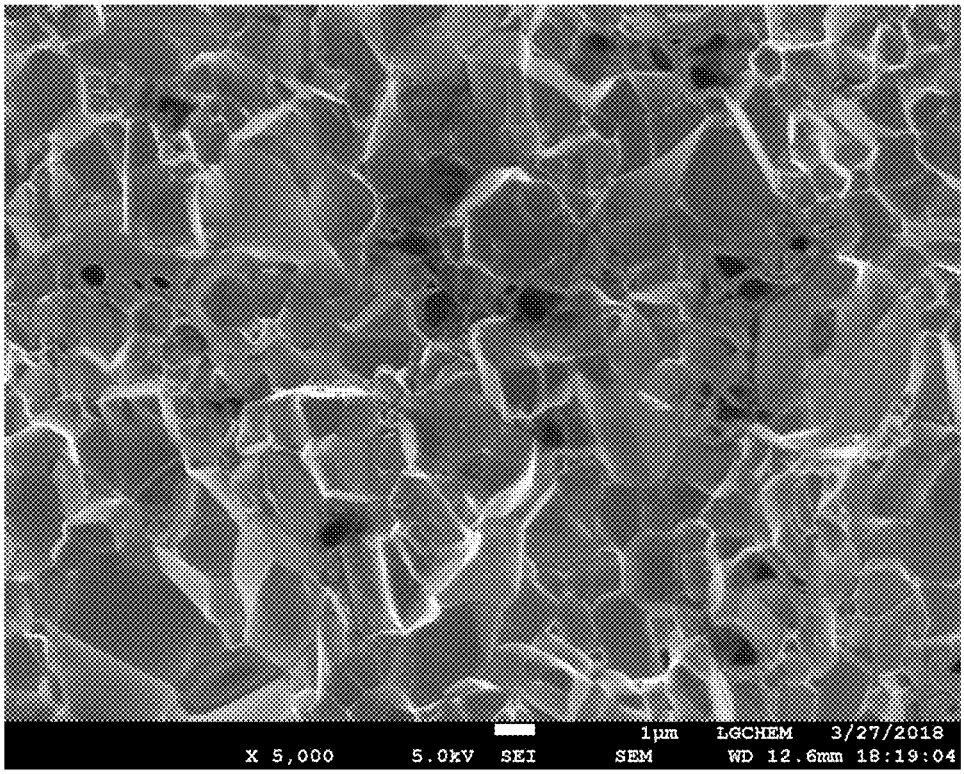

【FIG. 9】
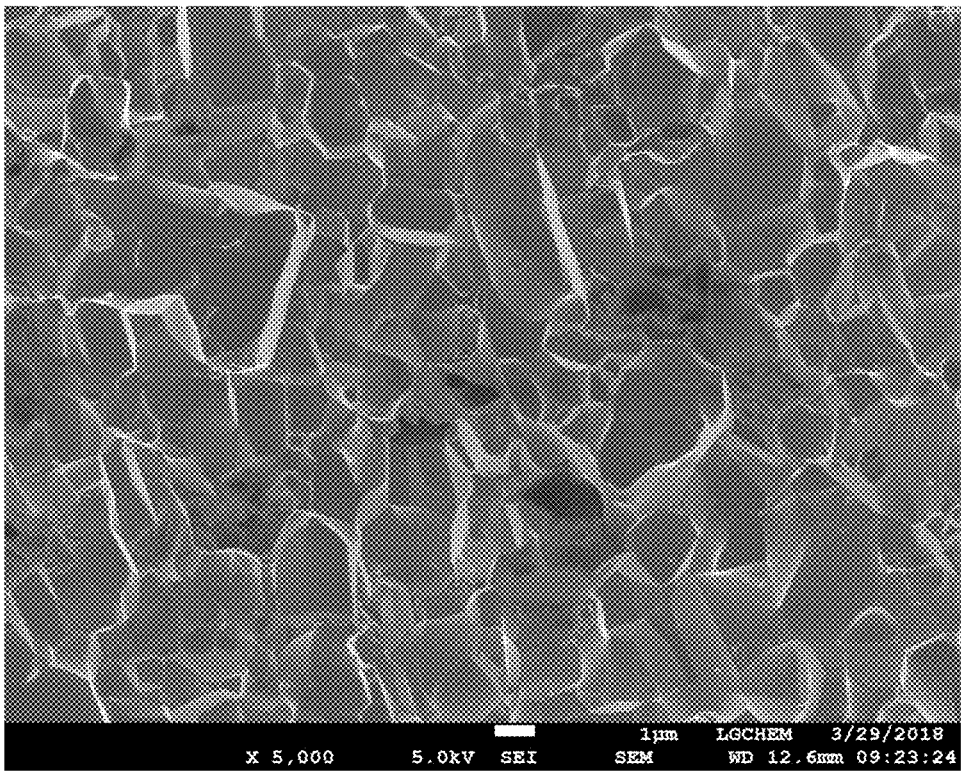
【FIG. 10】
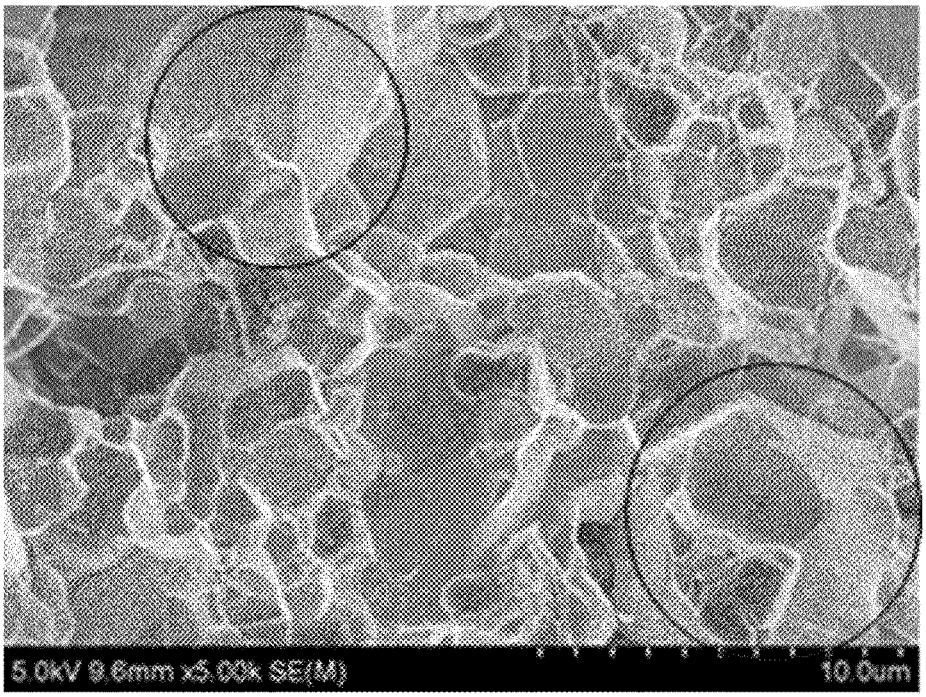

METHOD OF PREPARING MAGNETIC POWDER, AND MAGNETIC POWDER

CROSS-REFERENCE TO RELATED APPLICATIONS

This application is a national phase entry under 35 U.S.C. § 371 of International Application No. PCT/KR2019/010377, filed Aug. 14, 2019, which claims priority to Korean Patent Application No. 10-2018-0099499 filed on Aug. 24, 2018, the disclosures of which are incorporated herein by reference.

TECHNICAL FIELD

The present disclosure relates to a method of preparing magnetic powder and magnetic powder prepared thereby, and more particularly, to the method of preparing NdFeB-based magnetic powder and the magnetic powder prepared thereby.

BACKGROUND OF ART

An NdFeB-based magnet is a permanent magnet having a composition of $Nd_2Fe_{14}B$, which is a compound of neodymium (Nd), i.e., a rare-earth element, iron and boron (B), and this magnet has been used as a general-purpose permanent magnet for 30 years since its development in 1983. This NdFeB-based magnet is used in various fields such as electronic information, automobile industry, medical equipment, energy, transportation, etc. In particular, with a recent trend of weight lightening and miniaturization, such magnet has been used in products such as machine tools, electronic information devices, home electronic appliances, mobile phones, robot motors, wind power generators, small motors for automobile, driving motors and the like.

It is known that the NdFeB-based magnet is generally prepared by a strip/mold casting or melt spinning method based on metal powder metallurgy. First of all, the strip/mold casting method refers to a process of melting metals such as neodymium (Nd), iron (Fe), boron (B), etc. through heat-treatment to prepare an ingot; coarsely pulverizing crystal grain particles; and preparing microparticles through a refining process. This process is repeated to obtain powder, which then undergoes a pressing and sintering process under a magnetic field to produce an anisotropic sintered magnet.

Also, the melt spinning method is performed in such a way that metal elements are melt; then poured into a wheel rotating at a high speed to be quenched; then pulverized with a jet mill; then blended with a polymer to form a bonded magnet or pressed to prepare a magnet.

However, there is a problem in that these methods all necessarily require a pulverization process, which takes a long time, and such methods also need a process of coating a surface of the resulting powder after pulverization. Also, the existing $Nd_2Fe_{14}B$ microparticles are prepared in such a way that raw materials are melted (at 1500-2000° C.) and quenched to obtain lumps, and these lumps are then subjected to multi-step treatment with coarse pulverization and hydrogen crushing/jet milling. Thus, a shape of the resulting particles becomes irregular, and there is a limit in miniaturizing particles.

Recently, a keen attention has been paid to a method of preparing magnetic powder by a reduction-diffusion method. For example, even NdFeB fine particles may be prepared through a reduction-diffusion process, in which $Nd_2O_3$, Fe and B are mixed together and reduced with Ca, etc. However, this method utilizes micro iron powder (mainly carbonyl iron powder) as a starting material, and thus has a problem in that it is impossible to prepare magnetic particles having a size equal to or less than the size of iron particles, and a cost of production is high due to expensive micro iron powder.

Also, in a process of sintering magnetic powder to obtain a sintered magnet, this sintering proceeds in a temperature range of 1,000° C. to 1,250° C. to carry out densification and thus obtain a net density. When the sintering proceeds within the temperature range, there necessarily occurs a growth of crystal grains, which acts as a factor for decreasing coercive force. A relationship between the size of crystal grain and the coercive force has been experimentally revealed as shown in Equation 1 below.

$HC=a+b/D$ ($HC$: magnetic moment, $a$ and $b$: constant, $D$: crystal grain size) [Equation 1]

According to the Equation 1, the coercive force of a sintered magnet tends to decrease, as the size of crystal grain becomes larger. In addition, while sintering, there occur the growth of crystal grains (at least 1.5 times more than the size of initial powder) as well as the growth of abnormal particles (at least twice more than the size of general crystal grain), and thus the coercive force of the sintered magnet is greatly decreased more than the theoretical coercive force that the initial powder may have.

Accordingly, as a method for suppressing the growth of crystal grains while sintering, there are a HDDR (hydrogenation, disproportionation, desorption and recombination) process; a method of deceasing a size of initial powder through jet mill pulverization; a method of forming a triple point with addition of an element capable of forming a secondary phase to suppress movement of a crystal grain boundary; etc.

However, the coercive force of the sintered magnet may be secured to some degree through the various methods mentioned above, but the process itself is very complicated and still insufficient to have an effect on suppressing the growth of crystal grains while sintering. Also, there occur other problems, such as a decrease in characteristics of the sintered magnet due to a great change in a fine structure caused by the movement of crystal grains; a decrease in magnetic characteristics due to an added element; etc.

DETAILED DESCRIPTION OF THE INVENTION

Technical Problem

A task to be solved by embodiments of the present disclosure is to solve the problems as above, and the embodiments of the present disclosure are to provide a method of preparing magnetic powder and the magnetic powder prepared thereby, which reduces a process cost when preparing magnetic powder by a reduction-diffusion method, and then suppresses a growth of crystal grains in the process of sintering the magnetic powder to have highly coercive characteristics.

Technical Solution

A method of preparing magnetic powder according to an embodiment of the present disclosure for solving the above problems includes the steps of: preparing iron powder by a reduction reaction of iron oxide; preparing magnetic powder by heat-treating a molded article prepared by pressure-molding a mixture containing the iron powder, neodymium oxide, boron and calcium at a pressure of 22 MPa or more; and coating an organic fluoride on a surface of the magnetic powder.

The step of preparing the iron powder may include a step of performing a reduction reaction on a mixture of one of an oxide of an alkali metal or an oxide of an alkaline earth metal with iron oxide in the presence of a reducing agent under an inert gas atmosphere.

The mixture containing the iron powder, neodymium oxide, boron and calcium may be prepared by adding the neodymium oxide, the boron, and the calcium to the iron powder.

The step of preparing the iron powder may include a step of preparing a mixture containing iron powder and neodymium oxide by performing a reduction reaction on a wet mixed mixture of iron powder and neodymium oxide in an organic solvent in the presence of a reducing agent.

The mixture containing the iron powder, neodymium oxide, boron and calcium may be prepared by adding the boron and the calcium to the mixture of the iron powder and the neodymium oxide.

A reducing agent may be used in the reduction reaction of the iron oxide, and the reducing agent may include at least one of a hydride of an alkali metal or a hydride of an alkaline earth metal.

The step of preparing the iron powder may further include the steps of: removing a by-product from the iron powder obtained by the reduction reaction using a quaternary ammonium-based methanol solution; and washing the iron powder from which the by-product is removed with a solvent, followed by drying.

The step of preparing the magnetic powder may be performed by a reduction-diffusion method.

The step of heat-treating the molded article may include a step of heat-treating the molded article to a temperature of 800° C. to 1,100° C. under an inert gas atmosphere.

After the step of preparing the magnetic powder, the present method may further include the steps of: pulverizing the molded article to obtain powder; removing a by-product using a quaternary ammonium-based methanol solution; and washing the powder from which the by-product is removed with a solvent, followed by drying.

The organic fluoride may include at least one of perfluorinated carboxylic acid (PFCA)-based materials having 6 to 17 carbon atoms.

The organic fluoride may include perfluoro octanoic acid (PFOA).

The step of coating the organic fluoride may include a step of mixing the magnetic powder and the organic fluoride in an organic solvent, followed by drying.

The step of mixing and drying may further include a step of mixing the magnetic powder, the organic fluoride and the organic solvent, followed by pulverizing in a turbula mixer.

The organic solvent may be acetone, ethanol or methanol.

The magnetic powder may include $Nd_2Fe_{14}B$ powder having a particle size of 1.2 to 3.5 micrometers.

When a sintered magnet is prepared by heat-treating the magnetic powder, a film of neodymium fluoride may be formed on a surface of crystal grain of the sintered magnet.

The crystal grain may have a particle size of 1 to 5 micrometers.

Advantageous Effects

According to embodiments of the present disclosure, magnetic powder may be provided not by separately adding iron powder, followed by using as usual, but by a reduction-diffusion method which uses the iron powder provided by a reduction reaction of iron oxide. Thus, the magnetic powder prepared according to the embodiments of the present disclosure may be provided as ultrafine particles having a regular shape as well as a size of micrometer or less, and may reduce a manufacturing cost at the same time because of not using expensive fine iron powder.

Also, a crystal grain growth of magnetic powder particles may be suppressed to a level of an initial powder size in the process of sintering in such a way that an organic fluoride is coated on a surface of the magnetic powder particles. And, the magnetic powder with high density may be prepared through a lubrication action of the organic fluoride coated on the surface of magnetic powder particles in the process of molding prior to sintering.

BRIEF DESCRIPTION OF THE DRAWINGS

FIG. 1 is a graph of illustrating X-ray diffraction (XRD) patterns of iron powders after reduction of iron oxide ($Fe_2O_3$) according to Examples 1 and 2 of the present disclosure.

FIG. 2 is a graph of illustrating XRD patterns of magnetic powders according to Examples 2 to 4.

FIG. 3 is a graph of illustrating XRD patterns of magnetic powders according to Comparative Examples 1 and 2.

FIG. 4*a* is a SEM image of iron powder after reduction of iron oxide ($Fe_2O_3$) according to Example 1.

FIG. 4*b* is a SEM image shown by changing a magnification of the SEM image illustrated in FIG. 4*a*.

FIG. 5*a* is a SEM image of magnetic powder according to Example 2.

FIG. 5*b* is a SEM image shown by changing a magnification of the SEM image illustrated in FIG. 5*a*.

FIG. 6 is a graph of illustrating M-H data of magnetic powders according to Examples 2 and 3.

FIG. 7 is a graph of illustrating an enlarged view around an origin point of the graph of illustrating the M-H data of magnetic powders according to Examples 2 and 3.

FIG. 8 is a SEM image on a fracture surface of a sintered magnet prepared according to Example 5.

FIG. 9 is a SEM image on a fracture surface of a sintered magnet prepared according to Example 6.

FIG. 10 is a SEM image on a fracture surface of a sintered magnet prepared according to Comparative Example 3.

DETAILED DESCRIPTION OF THE EMBODIMENTS

Hereinafter, with reference to the accompanying drawings, various embodiments of the present disclosure will be described in more detail such that those skilled in the art, to which the present disclosure pertains, may easily practice the present disclosure. The present disclosure may be implemented in various different forms, and is not limited to the embodiments described herein.

Also, throughout the present specification, when any part is said to "include" or "comprise" a certain component, this means that the part may further include other components rather than excluding the other components, unless otherwise particularly specified.

As described above, when conventionally preparing magnetic powder, $Nd_2Fe_{14}B$ particles of 2 to 3 micrometers might be obtained only in such a way that raw materials are melted at a high temperature of 1,500° C. to 2,000° C. and quenched to obtain lumps, and these lumps are then subjected to coarse pulverization and hydrogen crushing/jet milling. However, such method needs a high temperature for melting the raw materials and then requires a process of cooling down the resulting molten materials again, followed by pulverizing, and thus this method is time consuming and complicated. Also, a separate surface treatment is required to reinforce corrosion resistance and enhance electrical resistance, etc of the $Nd_2Fe_{14}B$ magnetic powder coarsely pulverized as above.

On contrary, in the present disclosure, magnetic particles may be prepared through a reduction-diffusion process using the iron powder obtained by reducing the iron oxide without an existing multi-step pulverization process, and thus process efficiency may be increased compared to the conventional method.

Also, the existing reduction-diffusion process uses micro iron powder such as carbonyl iron powder, etc., and thus it was impossible to prepare iron powder particles having a size of micrometer or less. Herein, the size of micrometer or less means the size of 1 micrometer or less. However, the present disclosure is characterized by using the iron powder obtained by reducing the iron oxide in the reduction-diffusion process, and the iron powder has the size of micrometer or less. Therefore, ultrafine magnetic particles may be finally prepared.

Also, the reduction-diffusion process, which uses an existing metal metallurgy method and iron powder, has a problem in that its manufacturing cost is high due to the use of expensive iron powder. However, according to the present disclosure, there is an advantage in that the cost may be reduced by using the iron oxide as a raw material.

According to one embodiment of the present disclosure, a method of preparing magnetic powder includes steps of: preparing iron powder by a reduction reaction of iron oxide; preparing magnetic powder by heat-treating a molded article prepared by pressure-molding a mixture containing the iron powder, neodymium oxide, boron and calcium at a pressure of 22 MPa or more; and coating an organic fluoride on a surface of the magnetic powder.

Hereinafter, the method of preparing magnetic powder according to the present disclosure will be described in more detail.

In the present disclosure, the step of preparing the iron powder may use any one selected from the two methods to be described below for the reduction reaction of iron oxide.

In the method of preparing magnetic powder according to a first exemplary embodiment of the present disclosure, the step of preparing the iron powder may include a step of performing a reduction reaction on a mixture of one of an oxide of an alkali metal or an oxide of an alkaline earth metal with iron oxide in the presence of a reducing agent under an inert gas atmosphere. Preferably, a material mixed with the iron oxide may be one of oxides of an alkaline earth metal, and for example, calcium oxide may be used.

A mixture containing the iron powder, neodymium oxide, boron and calcium may be prepared by adding the neodymium oxide, the boron and the calcium to the iron powder.

A method of preparing magnetic powder according to a second exemplary embodiment of the present disclosure may include a step of preparing a mixture containing iron powder and neodymium oxide by performing a reduction reaction on a wet mixed mixture of neodymium oxide and iron oxide in an organic solvent in the presence of a reducing agent.

The mixture containing the iron powder, neodymium oxide, boron and calcium may be prepared by adding the boron and the calcium to the mixture containing the iron powder and the neodymium oxide.

In particular, the step of performing a reduction reaction on iron oxide for preparing the iron powder is characterized by high temperature and high pressure conditions.

Herein, when a high pressure is not applied in the step of heat-treating a mixture of neodymium oxide, boron, iron and a reducing agent at a high temperature, the reduction reaction does not proceed because an excessive amount of by-products such as CaO is present in the mixture.

Therefore, in the present disclosure, the magnetic powder may be smoothly prepared by performing pressurization under the high pressure condition at a high temperature during the reduction reaction of iron oxide, thereby solving a problem in which particles are not diffused well due to an excessive amount of the by-products. Preferably, in the first and second exemplary embodiments, a pressure applied to the mixture may be 22 MPa or more. When the pressure applied to the mixture is less than 22 MPa, the particles may not be diffused well and thus the reaction may not proceed. Herein, when the pressure satisfies its lower limit or more, a synthetic reaction for forming the magnetic powder may occur due to a sufficient diffusion of the particles.

More preferably, the pressure may be 35 MPa or more.

As a growing pressure leads to a more diffusion of the particles, the synthetic reaction may proceed well. In Examples 1, 2, 3 and 4 to be described below herein, it can be confirmed that the synthetic reaction proceeds well even under the condition of pressurization at 100 MPa, 150 MPa and 200 MPa in addition to a pressure value of 35 MPa. However, it is not preferable that the pressure value applied becomes unlimitedly large. In other words, in the first and second exemplary embodiments, when the pressure applied to the mixture is more than 200 MPa, the mixed powder may become uneven in the process of applying the pressure, and thus the reaction may not proceed either. In this regard, more description will be provided in Comparative Example 2 to be described below.

Specifically, in the present disclosure, a hydride of an alkali metal or a hydride of an alkaline earth metal is used as a reducing agent, and thus an oxide of an alkali metal or an oxide of an alkaline earth metal is produced in the step of reducing the iron oxide, and this oxide acts as a by-product. Due to the presence of an excessive amount of such oxides, the reaction of preparing the magnetic power may not proceed at atmospheric pressure or at a pressure lower or too higher than the present disclosure.

However, in embodiments according to the present disclosure, the problem caused by the excessive by-product may be solved because the mixture is pressure-molded at the high pressure within the above range along with the use of a reducing agent such as $CaH_2$, etc.

Herein, in the process of removing the by-product, a washing and removing process may be performed once or twice according to the reduction step as shown in the first and second exemplary embodiments. In other words, in the first exemplary embodiment, the washing and removing process may be performed twice. In the second exemplary embodiment, the washing and removing process may be performed once.

For example, in the first exemplary embodiment, iron oxide, calcium oxide and a reducing agent are mixed together to prepare iron powder; then washed to remove a by-product, i.e., calcium oxide; and then mixed with neodymium oxide, boron and calcium to carry out a reduction synthesis step afterwards. Since the calcium oxide produced from this step has to be washed and removed again, the process of washing and removing the by-product (CaO) may be performed twice in the first exemplary embodiment.

Also, in the second exemplary embodiment, a mixture of neodymium oxide, iron oxide and a reducing agent is subjected to reduction reaction, and then mixed with boron and calcium without washing and removing the by-product to perform the reduction synthesis step. The process of washing and removing the by-product proceeds after the synthesis reaction. Thus, the process of washing and removing the by-product may proceed once in the second exemplary embodiment.

At that time, in both of the first and second exemplary embodiments, NdFeB sintered magnet particles with excellent magnetism may be prepared. However, a further less number of processes may minimize the oxidization of particles which may be produced in the washing process, and may lead to a uniform mixing of Nd and Fe to better form NdFeB magnetic particles. Thus, preferably the second exemplary embodiment may proceed. In other words, in the first and second exemplary embodiments, the by-product may be all produced in the process of reducing iron oxide. Out of them, in the first exemplary embodiment, as one of an oxide of an alkali metal or an oxide of an alkaline earth metal may be further put in the process of reducing the iron oxide, the by-product of the first exemplary embodiment may be produced much more than the by-product of the second exemplary embodiment. Thus, in the first exemplary embodiment, the synthesis reaction can proceed only if a washing process proceeds in the middle of the reaction, and thus it is preferable to perform the washing process twice. And, in the second exemplary embodiment, due to relatively less by-product, synthesis can proceed without washing after the process of reducing the iron oxide, and thus the washing process may proceed only once.

In such first and second exemplary embodiments of the present disclosure, the iron oxide may be a material well-known in this art, for example, ferrous oxide (FeO), ferric oxide ($Fe_2O_3$) or a mixed thereof ($Fe_3O_4$).

The reduction reaction may include a step of heat-treatment at a temperature of 300° C. to 400° C.

The reducing agent may be a hydride of an alkali metal or a hydride of an alkaline earth metal. Preferably, the reducing agent may be at least one selected from the group consisting of $CaH_2$, NaH, $MgH_2$ and KH.

Also, the step of preparing the iron powder according to the first exemplary embodiment may further include the steps of: removing a by-product from the iron powder obtained by the reduction reaction using a quaternary ammonium-based methanol solution; and washing the iron powder from which the by-product is removed with a solvent, followed by drying.

Particularly, since an oxide of an alkali metal or an alkaline earth metal may be produced as a by-product of reduction after the reduction reaction of iron oxide for preparing the iron powder, it is preferable to remove the by-product of reduction. Thus, in one embodiment of the present disclosure, the iron powder may be obtained by removing the by-product by using a quaternary ammonium-based methanol solution, and then undergoing a washing process with a solvent, followed by drying.

The quaternary ammonium-based methanol solution may be an $NH_4NO_3$-MeOH solution, an $NH_4Cl$-MeOH solution or an $NH_4Ac$-MeOH solution, preferably the $NH_4NO_3$-MeOH solution. And, a concentration of the solution may be 0.1 M to 2 M.

The step of washing with the solvent may use an alcohol such as methanol, ethanol, etc., and an organic solvent such as acetone, but types thereof are not limited.

In the step of preparing the iron powder according to the second exemplary embodiment, an organic solvent used for wet mixing may be an organic solvent such as ethanol, methanol, acetone, etc., but types thereof are not limited. In this case, the powder used therein does not need to be dissolved in the solvent, and thus any solvent may be used as long as it can be made into a dispersion or suspension state with the organic solvent.

The iron powder obtained from the process may be prepared to have a fine size and thus may be immediately used in the process of preparing magnetic powder. Accordingly, the present disclosure does not need to use such expensive micrometer-sized iron powder. According to an embodiment of the present disclosure, a particle size of the iron powder obtained by the reduction reaction of iron oxide may be 0.1 to 1 micrometer.

Meanwhile, the step of preparing magnetic powder may be performed by a reduction-diffusion method. Herein, the reduction-diffusion method may be any one selected from the two methods to be described below.

In the method of preparing magnetic powder according to the first exemplary embodiment of the present disclosure, the step of preparing the magnetic powder by the reduction-diffusion method may include steps of: preparing a mixture by adding neodymium oxide, boron and calcium to the iron powder prepared by a reduction reaction of iron oxide; preparing a molded article by pressure-molding the mixture at a pressure of 22 MPa or more; and preparing magnetic powder by heat-treating the molded article.

In the method of preparing magnetic powder according to the second exemplary embodiment of the present disclosure, the step of preparing the magnetic powder by the reduction-diffusion method may include steps of: preparing a mixture by adding boron and calcium to a mixture containing the iron powder prepared by a reduction reaction of iron oxide and neodymium oxide; preparing a molded article by pressure-molding the mixture at a pressure of 22 MPa or more; and preparing magnetic powder by heat-treating the molded article. As described above, in case of the second exemplary embodiment, the process of washing and removing a by-product produced (ex: CaO) has to be performed only once throughout the whole process, and thus there is an advantage in that the number of processes may be reduced compared to the first exemplary embodiment in which such process has to be performed twice, and there is also an advantage in that NdFeB magnetic particles may be better formed because Nd and Fe may be uniformly mixed together.

In the first and second exemplary embodiments, the step of heat-treating the molded article may include a step of heat-treating the molded article at a temperature of 800° C. to 1,100° C. under an inert gas atmosphere.

The pressure-molded article may be prepared by using a pressurization method selected from the group consisting of hydraulic press, tapping and cold isostatic pressing (CIP).

The heat-treatment may proceed at a temperature of 800° C. to 1,100° C. under an inert gas atmosphere for 10 minutes to 6 hours. When the heat-treatment is performed for 10 minutes or less, the powder may not be sufficiently synthesized. When the heat-treatment is performed for 6 hours or more, there may be a problem in that the size of the powder becomes coarse and primary particles are formed together into lumps.

After heat-treating the molded article and obtaining powder by pulverizing the molded article, there may be further included the steps of: removing a by-product using a quaternary ammonium-based methanol solution; and washing the powder from which the by-product is removed with a solvent.

The step of washing with the solvent may use an alcohol such as methanol, ethanol, etc., and an organic solvent such as acetone, but types thereof are not limited.

The quaternary ammonium-based methanol solution may be an $NH_4NO_3$-MeOH solution, an $NH_4Cl$-MeOH solution or an $NH_4Ac$-MeOH solution, preferably the $NH_4NO_3$-MeOH solution. Also, a concentration of the solution may be 0.1 M to 2 M.

Moreover, in the present disclosure, the inert gas atmosphere may be an Ar atmosphere, or a He atmosphere.

Furthermore, in the steps of preparing iron powder and preparing magnetic powder, a drying process may proceed as a vacuum drying process, and a method thereof is not limited.

In the present disclosure, a ball-mill, a turbula mixer, etc., may be used for mixing each of components.

In the steps of preparing iron powder and preparing magnetic powder, a reactor may be a SUS tube when performing a reduction reaction and a reduction-diffusion method.

According to an embodiment of the present disclosure, there may be provided the magnetic powder prepared by the above-mentioned method.

This magnetic powder is prepared by the reduction-diffusion method using the fine iron powder prepared by a reduction reaction of iron oxide, and thus a size thereof may be finely controlled and the magnetic powder may have a regular particle shape.

Preferably, the magnetic powder may include NdFeB magnetic powder, i.e., $Nd_2Fe_{14}B$ powder having a size of 1.2 to 3.5 micrometers, 1.3 to 3.1 micrometers, or 2 to 3 micrometers.

Meanwhile, the method of preparing magnetic powder according to one embodiment of the present disclosure includes a step of coating an organic fluoride on a surface of the magnetic powder. The organic fluoride includes at least one of perfluorinated carboxylic acid (PFCA)-based materials having 6 to 17 carbon atoms as a perfluorinated compound (PFC). Specifically, it is preferable to include perfluorooctanoic acid (PFOA).

Out of the PFCA-based materials, the compound having 6 to 17 carbon atoms corresponds to perfluorohexanoic acid (PFHxA, C6), perfluoroheptanoic acid (PFHpA, C7), perfluorooctanoic acid (PFOA, C8), perfluorononanoic acid (PFNA, C9), perfluorodecanoic acid (PFDA, C10), perfluoroundecanoic acid (PFUnDA, C11), perfluorododecanoic acid (PFDoDA, C12), perfluorotridecanoic acid (PFTrDA, C13), perfluorotetradecanoic acid (PFTeDA, C14), perfluorohexadecanoic acid (PFHxDA, C16) and perfluoroheptadecanoic acid (PFHpDA, C17).

The step of coating an organic fluoride may include a step of mixing the magnetic powder and the organic fluoride in an organic solvent, followed by drying, and particularly may further include a step of pulverizing the magnetic powder, the organic fluoride and the organic solvent with a turbula mixer.

Also, the types of the organic solvent are not particularly limited, as long as the organic fluoride may be dissolved therein. However, the organic solvent is preferably acetone, ethanol or methanol.

Meanwhile, a sintered magnet may be prepared by sintering the magnetic powder coated with the organic fluoride.

The sintering process may include a step of preparing a molded article for a sintered magnet, by adding a sintering aid such as $NdH_2$ into the magnetic powder coated with the organic fluoride, followed by homogenizing; then putting the homogenized mixed powder into a graphite mold, followed by compressing; and then orienting the compressed mold by applying a pulse magnetic field. An NdFeB sintered magnet may be prepared by heat-treating the molded article for the sintered magnet under a vacuum atmosphere at a temperature of 1,030° C. to 1,070° C.

During sintering, there necessarily occurs a growth of crystal grains, which acts as a factor for decreasing coercive force.

To suppress the growth of crystal grains in the process of sintering, fluoride powder, etc., may be mixed in the magnetic powder. However, the sufficient diffusion of fluorides does not occur while heat-treating due to a failed even distribution of the fluorides in the magnetic powder, the growth of crystal grains may not be sufficiently suppressed in the process of sintering. However, in one embodiment of the present disclosure, instead of a dry mixing of the fluoride, an organic fluoride is dissolved in an organic solvent and then mixed with the magnetic powder, and thus a coating layer may be formed in such a way that the organic fluoride is evenly distributed on a surface of the magnetic powder. Accordingly, the organic fluoride coating is evenly distributed on the surface of the magnetic powder to effectively suppress the diffusion of materials. Thus, the growth of crystal grains may be limited to a level of an initial powder size in the process of sintering, in comparison with an opposite case. In result, a decrease in coercive force of the sintered magnet may be minimized by limiting the growth of crystal grains.

A particle size of the crystal grain may be 1 to 5 micrometers.

Also, a lubrication action is feasible by the organic fluoride coated on the surface of the magnetic powder. A molded article for the sintered magnet having a high density may be prepared through the lubrication action, and an NdFeB sintered magnet having a high density and a high performance may be prepared by heat-treating the molded article for the sintered magnet.

Meanwhile, upon heat-treatment for sintering, the magnetic powder reacts with the organic fluoride coated on the surface of the magnetic powder, and thus a film of neodymium fluoride may be formed on an interface of crystal grains of the sintered magnet. The neodymium fluoride is formed in reaction with oxygen on the surface of the magnetic powder, and thus may minimize diffusion of oxygen into the magnetic powder. Thus, a rare-earth sintered magnet having a high density may be prepared in such a way that a new oxidization reaction of magnetic particles is limited; corrosive resistance of the sintered magnet is enhanced; and a rare-earth element is suppressed from being unnecessarily consumed in oxide production.

Then, the method of preparing magnetic powder according to the present disclosure will be described through specific Examples and Comparative Examples hereinafter.

Example 1: Preparation of Magnetic Powder after Reduction Reaction of Iron Oxide 10 g of $Fe_2O_3$, 9.45 g of $CaH_2$ and 10 g of CaO were mixed together using a turbula mixer. The resulting mixture was put into a SUS tube of any shape, and subjected to a reaction in a tube furnace under an inert gas (Ar) atmosphere at 350° C. for 2 hours. After the reaction was completed, a by-product, i.e., CaO was removed by using a 1M $NH_4NO_3$-MeOH solution, then washed with acetone, and then vacuum-dried. 3.6 g of $Nd_2O_3$, 0.1 g of B and 2.15 g of Ca were put into a dried sample, and then mixed together again using the turbula mixer. The resulting mixture was molded by applying a pressure of 35 MPa using a hydraulic press, then put into a SUS tube of any shape, and then subjected to a reaction in the tube furnace under an inert gas (Ar) atmosphere at 950° C. for 1 hour. After the reaction was completed, the resulting sample was grounded into powder, after which a by-product, i.e., CaO was removed by using an $NH_4NO_3$-MeOH solution, then washed with acetone to finish a washing process, and then vacuum-dried to obtain an NdFeB-based magnetic powder.

Example 2: Preparation of Magnetic Powder after Reduction Reaction of Neodymium Oxide and Iron Oxide 13 g of $Nd_2O_3$ and 27 g of $Fe_2O_3$ were uniformly wet-mixed in ethanol using a ball-mill, after which the resulting mixture was dried under a vacuum atmosphere at 900° C. for 1 hour. 25.62 g of $CaH_2$ was further put into the dried sample, and then mixed together again using a turbula mixer. The resulting mixture was put into a SUS tube of any shape, and subjected to a reaction in a tube furnace under an inert gas (Ar) atmosphere at 350° C. for 2 hours. 0.3 g of B and 5.5 g of Ca were further put into the completely reacted sample, and then mixed together again using the turbula mixer.

The resulting mixture was molded by applying a pressure of 35 MPa using a hydraulic press, then put into a SUS tube of any shape, then subjected to a reaction by the method presented in Example 1, and then followed by post-treatment to obtain $Nd_2Fe_{14}B$ powder.

Example 3: Preparation of Magnetic Powder after Reduction Reaction of Neodymium Oxide and Iron Oxide 10.84 g of $Nd_2O_3$ and 30 g of $Fe_2O_3$ were uniformly wet-mixed in ethanol using a ball-mill, after which the resulting mixture was dried under a vacuum atmosphere at 900° C. for 1 hour. 28.5 g of $CaH_2$ was further put into the dried sample, and then mixed together again using a turbula mixer. The resulting mixture was put into a SUS tube of any shape, and subjected to a reaction in a tube furnace under an inert gas (Ar) atmosphere at 350° C. for 2 hours. 0.3 g of B and 4.5 g of Ca were further put into the completely reacted sample, and then mixed together again using the turbula mixer.

The resulting mixture was molded by applying a pressure of 35 MPa using a hydraulic press, then put into a SUS tube of any shape, then subjected to a reaction by the method presented in Example 1, and then followed by post-treatment to obtain $Nd_2Fe_{14}B$ powder.

Example 4: Preparation of Magnetic Powder after Reduction Reaction of Neodymium Oxide and Iron Oxide 6.1 g of $Nd_2O_3$ and 18.65 g of $Fe_3O_4$ were uniformly wet-mixed in ethanol using a ball-mill, after which the resulting mixture was dried under a vacuum atmosphere at 900° C. for 1 hour. 16.27 g of $CaH_2$ was further put into the dried sample, and then mixed together again using a turbula mixer. The resulting mixture was put into a SUS tube of any shape, and subjected to a reaction in a tube furnace under an inert gas (Ar) atmosphere at 350° C. for 2 hours. 0.19 g of B and 2.61 g of Ca were further put into the completely reacted sample, and then mixed together again using the turbula mixer. The resulting mixture was molded by applying a pressure of 35 MPa using a hydraulic press, then put into a SUS tube of any shape, then subjected to a reaction by the method presented in Example 1, and then followed by post-treatment to obtain $Nd_2Fe_{14}B$ powder.

Example 5: Coating of Magnetic Powder with PFOA (Pulverizing Using Turbula Mixer for 2 Hours)

10 g of NdFeB-based magnetic powder and 50 mg of perfluorooctanoic acid (PFOA), 60 g of zirconia ball having 5 mm in diameter, and 125 ml of an organic solvent such as acetone, methanol or the like were put into an airtight plastic bottle, and then pulverized using a turbula mixer for 2 hours. By this method, NdFeB-based magnetic powder having a particle size of 0.5 to 10 micrometers and coated with PFOA was prepared. 10 g of the NdFeB-based magnetic powder was homogenized by adding 1 g of $NdH_2$ powder as a sintering aid. After that, the homogenized mixture was put into a graphite mold, followed by compressing; then oriented by applying a pulse magnetic field to prepare a molded article for a sintered magnet; and then heat-treated under a vacuum atmosphere at a temperature of 1,030° C. to 1,070° C. for 2 hours to prepare an NdFeB-based sintered magnet.

Example 6: Coating of Magnetic Powder with PFOA (Pulverizing Using Turbula Mixer for 4 Hours)

Pulverization was performed using a turbula mixer under the same pulverization condition as shown in Example 5 to obtain an NdFeB-based magnetic powder coated with PFOA. The NdFeB-based magnetic powder was heat-treated under the same condition as shown in Example 5 to prepare an NdFeB-based sintered magnet.

Comparative Example 1: Preparation of Magnetic Powder at Pressure of 35 MPa or Less 10.84 g of $Nd_2O_3$ and 30 g of $Fe_2O_3$ were uniformly wet-mixed in ethanol using a ball-mill, after which the resulting mixture was dried under a vacuum atmosphere at 900° C. for 1 hour. 28.5 g of $CaH_2$ was further put into the dried sample, and then mixed together again using a turbula mixer. The resulting mixture was put into a SUS tube of any shape, and subjected to a reaction in a tube furnace under an inert gas (Ar) atmosphere at 350° C. for 2 hours. 0.3 g of B and 4.5 g of Ca were further put into the completely reacted sample, and then mixed together again using the turbula mixer. The resulting mixture was molded by applying a pressure of 10 MPa with a tapping method, then put into a SUS tube of any shape, then subjected to a reaction by the method presented in Example 1, and then followed by post-treatment to obtain NdFeB-based magnetic powder.

Comparative Example 2: Preparation of Magnetic Powder at Pressure of 200 MPa or More 6.1 g of $Nd_2O_3$ and 18.65 g of $Fe_3O_4$ were uniformly wet-mixed in ethanol using a ball-mill, after which the resulting mixture was dried under a vacuum atmosphere at 900° C. for 1 hour. 16.27 g of $CaH_2$ was further put into the dried sample, and then mixed together again using a turbula mixer. The resulting mixture was put into a SUS tube of any shape, and subjected to a reaction in a tube furnace under an inert gas (Ar) atmosphere at 350° C. for 2 hours. 0.19 g of B and 2.61 g of Ca were further put into the completely reacted sample, and then mixed together again using the turbula mixer. The resulting mixture was molded by applying a pressure of 220 MPa with CIP, then put into a SUS tube of any shape, then subjected to a reaction by the method presented in Example 1, and then followed by post-treatment to obtain NdFeB-based magnetic powder.

Comparative Example 3: NdFeB-Based Mixed Powder not Coated with PFOA 20 g of NdFeB-based magnetic powder and 100 g of zirconia ball having 5 mm in diameter were put into an airtight plastic bottle, and then pulverized using a paint shaker for 40 minutes to prepare NdFeB-based magnetic powder having a particle size of 0.5 to 20 micrometers and not coated with PFOA. 20 g of the NdFeB-based magnetic powder was homogenized by adding 2 g of $NdH_2$ powder as a sintering aid. The homogenized mixture was heat-treated under the same condition as shown in Example 5 to prepare an NdFeB-based sintered magnet.

Experimental Example 1: XRD pattern XRD patterns of the magnetic powders prepared in Examples 1 to 4 and Comparative Examples 1 and 2 were analyzed and shown in FIGS. 1 to 3. FIG. 1 is a graph of illustrating an X-ray diffraction (XRD) pattern of iron powder after reduction of iron oxide ($Fe_2O_3$) according to Examples 1 and 2 of the present disclosure. FIG. 2 is a graph of illustrating an XRD pattern of magnetic powder according to Examples 2 to 4. FIG. 3 is a graph of illustrating an XRD pattern of magnetic powder according to Comparative Examples 1 and 2. In FIG. 1, the numbers 1 and 2 represent Examples 1 and 2, respectively. In FIG. 2, the numbers 2 to 4 represent Examples 2 to 4, respectively. Also, in FIG. 3, the numbers 1 and 2 represent Comparative Examples 1 and 2, respectively.

As shown in FIG. 1, it was confirmed that iron powder is prepared after reduction of iron oxide ($Fe_2O_3$). It was confirmed from Examples 2 to 4 of FIG. 2 that single-phase $Nd_2Fe_{14}B$ powder was formed. On contrary, in case of Comparative Examples 1 and 2 of FIG. 3, since a pressure was excessive or insufficient due to a large amount of CaO upon a synthesis reaction when preparing a molded article for reacting magnetic powder, an $Nd_2Fe_{14}B$ synthesis did not proceed and Fe remains in a reduced powder state.

Experimental Example 2: Scanning Electron Microscope Image of Magnetic Powder

A size of the magnetic powders prepared in Examples 1 and 2 was measured using a scanning electron microscope (SEM) and shown in FIGS. 4*a* to 5*b*. FIG. 4*a* is a SEM image of magnetic powder according to Example 1. FIG. 4*b* is a SEM image shown by changing a magnification of iron powder after reduction of iron oxide ($Fe_2O_3$) illustrated in FIG. 4*a*. FIG. 5*a* is a SEM image of iron powder according to Example 2. FIG. 5*b* is a SEM image shown by changing a magnification of magnetic powder according to Example 2 illustrated in FIG. 5*a*.

Referring to FIGS. 4*a* and 4*b*, it might be confirmed that $Nd_2Fe_{14}B$ powder having a size of 0.16 to 0.88 micrometers was prepared in Example 1.

Referring to FIGS. 5*a* and 5*b*, it might be confirmed that $Nd_2Fe_{14}B$ powder having a size of 1.31 to 3.06 micrometers was prepared in Example 2.

Experimental Example 3: M-H data M-H data (magnetic hysteresis curve) of NdFeB powder according to Examples 2 and 3 were measured and shown in FIGS. 6 and 7. FIG. 6 is a graph of illustrating the M-H data of magnetic powder according to Examples 2 and 3. FIG. 7 is a graph of illustrating an enlarged view around an origin point of the graph of illustrating the M-H data of magnetic powder according to Examples 2 and 3.

Referring to FIGS. 6 and 7, a magnetic hysteresis curve of NdFeB magnetic powder was identified in Examples 2 and 3, in which magnet was prepared by pressurizing within a certain range of pressures by a hydraulic press method. FIG. 7 above was shown to identify x, y sections by enlarging a view around an origin point of FIG. 6, and it was identified that both Examples 2 and 3 above showed excellent magnetism.

Experimental Example 4: Scanning Electron Microscope Image of Fracture Surface of Sintered Magnet FIG. 8 shows a SEM image on a fracture surface of the sintered magnet prepared with NdFeB-based magnetic powder, of which surface was coated with PFOA by pulverizing using a turbula mixture for 2 hours, followed by mixing according to Example 5. FIG. 9 shows a SEM image on a fracture surface of the sintered magnet prepared with NdFeB-based magnetic powder, of which surface was coated with PFOA by pulverizing using a turbula mixer for 4 hours, followed by mixing according to Example 6. FIG. 10 shows a SEM image on a fracture surface of the sintered magnet prepared with NdFeB-based magnetic powder, of which surface was not coated with PFOA according to Comparative Example 3.

Referring to FIG. 10, the growth of crystal grains was observed as marked therein in the sintered magnet prepared with the magnetic powder not coated with PFOA had. On the other hand, referring to FIGS. 8 and 9, the growth of crystal grains as shown in FIG. 10 was not observed in the sintered magnet prepared with the magnetic powder coated with PFOA.

Preferred Examples of the present disclosure have been described in detail as above, but the scope of the present disclosure is not limited thereto, and their various modifications and improved forms made by those skilled in the art using a basic concept of the present disclosure defined in the following claims also belong to the scope of the present disclosure.

The invention claimed is:

1. A method of preparing magnetic powder, comprising:

preparing iron powder by a reduction reaction of iron oxide;

preparing magnetic powder by heat-treating a molded article prepared by pressure-molding a mixture containing the iron powder, neodymium oxide, boron and calcium at a pressure of 22 MPa or more; and coating an organic fluoride on a surface of the magnetic powder, wherein the preparing the iron powder comprises preparing a mixture containing the iron powder and the neodymium oxide by performing a reduction reaction on a wet mixed mixture of the iron oxide and the neodymium oxide in an organic solvent in the presence of a reducing agent.

2. A method of preparing magnetic powder, comprising:

preparing iron powder by a reduction reaction of iron oxide;

preparing magnetic powder by heat-treating a molded article prepared by pressure-molding a mixture containing the iron powder, neodymium oxide, boron and calcium at a pressure of 22 MPa or more; and coating an organic fluoride on a surface of the magnetic powder, wherein the preparing the iron powder comprises performing a reduction reaction on a mixture of one of an oxide of an alkali metal or an oxide of an alkaline earth metal with the iron oxide in the presence of a reducing agent under an inert gas atmosphere.

3. The method of preparing magnetic powder of claim 2, wherein the mixture containing the iron powder, the neodymium oxide, the boron and the calcium is prepared by adding the neodymium oxide, the boron, and the calcium to the iron powder.

4. The method of preparing magnetic powder of claim 1, wherein the boron and the calcium are further added to the mixture of the iron powder and the neodymium oxide.

5. The method of preparing magnetic powder of claim 1, wherein a reducing agent is used in the reduction reaction of the iron oxide, and the reducing agent comprises at least one of a hydride of an alkali metal or a hydride of an alkaline earth metal.

6. The method of preparing magnetic powder of claim 1, wherein the preparing the iron powder further comprises:

removing a by-product from the iron powder obtained by the reduction reaction using a quaternary ammonium-based methanol solution; and washing the iron powder from which the by-product is removed with a solvent, followed by drying.

7. The method of preparing magnetic powder of claim 1, wherein the preparing the magnetic powder is performed by a reduction-diffusion method.

8. The method of preparing magnetic powder of claim 1, wherein the heat-treating the molded article is performed at a temperature of 800° C. to 1,100° C. under an inert gas atmosphere.

9. The method of preparing magnetic powder of claim 1, further comprising:

after the preparing the magnetic powder, pulverizing the molded article to obtain a powder;

removing a by-product using a quaternary ammonium-based methanol solution; and washing the powder from which the by-product is removed with a solvent, followed by drying.

10. The method of preparing magnetic powder of claim 1, wherein the organic fluoride comprises at least one of perfluorinated carboxylic acid (PFCA)-based materials having 6 to 17 carbon atoms.

11. The method of preparing magnetic powder of claim 1, wherein the organic fluoride comprises perfluoro octanoic acid (PFOA).

12. The method of preparing magnetic powder of claim 1, wherein the coating the organic fluoride comprises mixing the magnetic powder and the organic fluoride in an organic solvent, followed by drying.

13. The method of preparing magnetic powder of claim 12, wherein the mixing and drying further comprises mixing the magnetic powder, the organic fluoride and the organic solvent, followed by pulverizing in a turbula mixer.

14. The method of preparing magnetic powder of claim 12, wherein the organic solvent is acetone, ethanol or methanol.

15. The method of preparing magnetic powder of claim 12, wherein the magnetic powder comprises $Nd_2Fe_{14}B$ powder having a particle size of 1.2 to 3.5 micrometers.

16. The method of preparing magnetic powder of claim 1, wherein when the magnetic powder is heat-treated to prepare a sintered magnet, a film of neodymium fluoride is formed on a surface of crystal grain of the sintered magnet.

17. The method of preparing magnetic powder of claim 16, wherein the crystal grain has a particle size of 1 to 5 micrometers.

18. The method of claim 1, wherein the pressure during the pressure-molding is from 22 MPa to 200 MPa.

* * * * *